United States Patent [19]

Kimura

[11] Patent Number: 4,843,378

[45] Date of Patent: Jun. 27, 1989

[54] FAILURE ALARM DEVICE FOR AN APPLIANCE

[75] Inventor: Kozo Kimura, Nara, Japan

[73] Assignee: Sharp Kabushiki Kaisha, Osaka, Japan

[21] Appl. No.: 99,731

[22] Filed: Sep. 22, 1987

[30] Foreign Application Priority Data

Sep. 22, 1986 [JP] Japan ..... 61-223982

[51] Int. Cl.[4] ..... G08B 21/00

[52] U.S. Cl. ..... 340/635; 340/292; 340/508

[58] Field of Search ..... 340/635, 508, 292, 693, 340/540, 691, 500

[56] References Cited

U.S. PATENT DOCUMENTS 3,641,570 2/1972 Thompson ..... 340/508

*Primary Examiner*—Joseph A. Orsino
*Assistant Examiner*—Jeffery A. Hofsass
*Attorney, Agent, or Firm*—Birch, Stewart, Kolasch & Birch

[57] ABSTRACT

The failure alarm device for an appliance of the present invention include a first alarm for indicating an abnormality if an abnormality should occur in the appliance main body, and a second alarm for indicating an abnormality if an abnormality should occur in the appliance main body and when the first alarm fails to function.

1 Claim, 1 Drawing Sheet

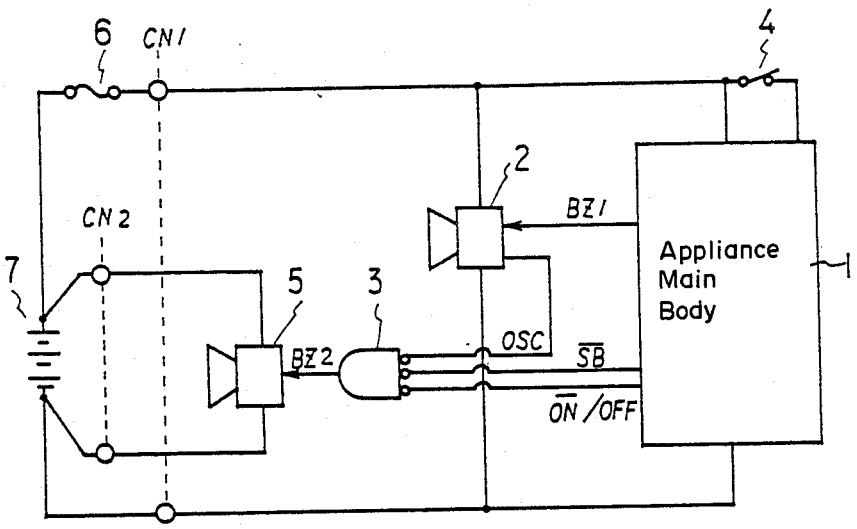
6
CN1
4
2
BZ1
CN2
Appliance
Main
Body
1
7
5
3
BZ2
OSC
SB
ON/OFF

FAILURE ALARM DEVICE FOR AN APPLIANCE

BACKGROUND OF THE INVENTION

This invention relates to a failure alarm device for an appliance, and more particularly to a device posessing two means for enabling an alarm which alarm indicates a mechanical or electrical failure of the appliance main body, capable of fulfilling the alarm function by one means if the other alarm means should fail to function.

An electronic appliance generally possesses a device to alert attention by notifying the user of the abnormality if its operation is abnormal or the occurrence of an abnormality is possible. This device is used not only in electronic appliances but also in all equipment. For the sake of convenience, only an example of an electronic appliance is described below.

The means generally used to notice an abnormality include the following.

a. Acoustic signal by buzzer or voice.

b. Visual signal by lamp or message display.

c. Action signal to stop the machine operation at the safer side. But these alarm means are not perfect, for example:

1. If the alarm itself becomes abnormal, it may be unable to fulfill its function effectively, for example if the buzzer is broken.

2. The signal to control the generation of an alarm is impaired, and the alarm cannot function; for example, the signal wire to sound the buzzer is broken.

3. The machine power source is cut off, and the entire machine including the alarm is stopped in a dangerous state; for example, the power fuse is blown off.

In the event of these abnormalities, the alarm function is not fulfilled.

In the cae of equipment in which an abnormality leads to danger of a man's life, such as medical appliances (blood transfusion pump, etc.), the failure of an alarm function is a serious matter.

SUMMARY OF THE INVENTION

It is therefore a primary object of this invention, in light of the above circumstances, to present a multiple alarm device possessing a second alarm to issue an alarm instead of a first alarm in case the first alarm fails to function normally in the event of accidents 1, 2, 3 above or the like, while the first alarm usually operates to detect an abnormality of the appliance main body.

Accordingly, the failure alarm device for equipment described in this invention includes a first alarm for indicating an abnormality if an abnormality should occur in the equipment main body, and a second alarm for indicating an abnormality when an abnormality occurs in the equipment main body and the first alarm fails to function properly, so that it is possible to notify the user of the abnormality by the second alarm if the first alarm fails to detect the abnormality of the equipment. As a result, the safety in the use of equipment is further enhanced, and it is particularly effective for medical appliances.

BRIEF DESCRIPTION OF THE DRAWING

The present invention will become more fully understood from the detailed description hereinbelow and the accompanying drawing which is given by way of illustration only, and thus is not limitative of the present invention and wherein:

The drawing is a circuit diagram of a failure alarm device for an appliance according to an embodiment of this invention.

DESCRIPTION OF THE PREFERRED EMBODIMENT

The constitution of this invention is described below while referring to the accompanying drawing.

The drawing is a circuit diagram of a failure alarm device for equipment according to an embodiment of this invention, in which numeral 1 denotes the electronic appliance main body.

To the appliance main body 1 is connected a first alarm buzzer 2. This first alarm buzzer 2 is driven by a control signal BZ1 which is delivered from the appliance main body 1 when an abnormal condition is detected in the appliance, thereby sounding the alarm.

At the same time, an OSC signal is delivered from the first alarm buzzer 2. This OSC signal is to sound the first alarm buzzer 2, and it becomes HIGH when sounding, and LOW when not sounding. This OSC signal is inverted and fed into an AND circuit 3.

From the appliance main body 1, a signal $\overline{SB}$ is delivered, aside from the signal BZ1, as an alarm control signal. This signal $\overline{SB}$ is inverted and fed into said AND circuit 3. These signals BZ1 and $\overline{SB}$ are delivered synchronously in their usual state. That is, when the signal BZ1 is HIGH, the signal $\overline{SB}$ is LOW. Meanwhile, independent output ports are used for the signal BZ1 and signal $\overline{SB}$ so that both signals may not be delivered at the same time due to simultaneous failure. For example, using two microprocessors, signal BZ1 and signal $\overline{SB}$ are delivered from individual microprocessors, or if using one microprocessor, the signal BZ1 is delivered from one output port, and the signal $\overline{SB}$ from another output port or by using a data bus.

As shown in the drawing, another control line $\overline{ON}$/-OFF is coming from the appliance main body 1. This $\overline{ON}$/OFF signal becomes LOW when the power switch 4 is turned on, and HIGH when the power switch is turned off, and it is delivered directly by way of a control circuit (microprocessor; not shown) of the appliance main body 1. This $\overline{ON}$/OFF signal is inverted and fed into the AND circuit 3, and hence it is designed so that the AND circuit 3 may not conduct when the power switch 4 is turned off.

From the AND circuit 3, a signal BZ2 is delivered, and when this signal BZ2 becomes HIGH, a second alarm buzzer 5 is driven and sounds. When the signal BZ2 becomes LOW, the second alarm buzzer 5 is no longer driven and stops sounding.

The appliance main body 1 and first alarm buzzer 2 are connected to a power source 7 in a main power source line composed of a power fuse 6 and connector CN1. The second alarm buzzer 5 is connected to the power source 7 in a separate line with connector CN2.

The operation of this embodiment is described below.

When the power switch 4 is in an ON state and the appliance main body 1 is operating normally, signals BZ1=LOW, $\overline{SB}$=HIGH, $\overline{ON}$ $\overline{OFF}$=LOW are delivered, and the first alarm buzzer 2 does not sound. Therefore, signal OSC=LOW, and signals OSC=LOW, $\overline{SB}$=HIGH, $\overline{ONOFF}$=LOW are fed into the AND circuit, so that signal BZ2 becomes LOW. As a result, the second alarm buzzer 5 does not sound.

When the power switch 4 is turned off, signals BZ1=LOW, $\overline{SB}$=LOW, $\overline{ON}$/OFF=HIGH, and signals OSC=LOW, $\overline{SB}$=LOW, $\overline{ON}$/OFF=HIGH are fed into the AND circuit, so that signal BZ2 becomes LOW. As a result, neither the first alarm buzzer 2 nor the second alarm buzzer 5 sounds.

When the appliance main body 1 detects an abnormality, signal BZ1=HIGH is delivered, and the first alarm buzzer 2 sounds. At the same time, signal $\overline{SB}$=LOW is also delivered, but since the signal OSC is HIGH due to sounding of the first alarm buzzer 2, and signals OSC=HIGH, $\overline{SB}$=LOW, $\overline{ON}$/OFF=LOW are fed into the AND circuit 3, the signal BZ2 becomes LOW. As a result, the second alarm buzzer 5 does not sound.

Due to trouble in the signal BZ1 or first alarm buzzer 2, if the signal to indicate the abnormality of appliance main body 1 is BZ1=HIGH, when the first alarm buzzer 2 does not sound, the second alarm buzzer 5 sounds.

The appliance main body 1 delivers $\overline{SB}$=LOW in synchronism with signal BZ1. Here, since the first alarm buzzer 2 is not sounding, the signal OSC is LOW, and signals OSC=LOW, SB=LOW, ON/OFF=-LOW are fed into the AND circuit, so that signal BZ2 becomes HIGH. As a result, the second alarm buzzer 5 is driven to sound.

If power is not supplied to the appliance main body 1 due to melting of the power fuse 6 or breakage of the connector CN1, or if the power is supplied, in the event of failure of the control circuit (microprocessor) of the appliance main body, such as stopping of oscillation of a clock or keeping of a reset signal, thereby making it impossible to deliver an alarm control signal, the signals become BZ1=LOW, SB=LOW, ON/OFF=LOW, OSC=LOW. Hence, the first alarm buzzer 2 does not sound, but the inputs of AND circuit are LOW, LOW, LOW, so that the second alarm buzzer 5 sounds.

To the contrary, if power is not supplied to the second alarm buzzer 5 due to disconnection of the connector CN2, or if the control signal $\overline{SB}$ or $\overline{ON}$ $\overline{OFF}$ becomes HIGH due to an abnormality of the appliance main body 1, so that the second alarm buzzer 5 does not sound, the appliance main body 1 delivers signal BZ1, so that the first alarm buzzer 2 sounds.

Thus, the second alarm buzzer 5 possesses the following features.

(1) An alarm indicator independent from the first alarm buzzer 2.

(2) The alarm is driven by a control signal independent from the first alarm buzzer.

(3) The alarm is connected to a power source independent from the appliance main body 1 and first alarm buzzer 2.

(4) The second alarm buzzer 5 does not function while the first alarm buzzer 2 is working normally.

While only one embodiment of the present invention has been described, it will be apparent to those skilled in the art that various changes and modifications may be made therein without departing from the spirit and scope of the present invention as claimed.

What is claimed is:

1. An alarm system for indicating fault conditions of an appliance comprising:

first alarm means for generating a first alarm signal in response to a first control signal indicative of fault conditions of an appliance, and generating an alarm failure signal when said first alarm means cannot generate said first alarm signal;

Means for generating a second alarm signal in response to both the fault conditions in said appliance and said alarm failure signal;

control means within said appliance for generating and applying said first control signal to said first alarm means and for generating a second control signal independently from said first control signal in response to the occurrence of fault conditions in said appliance, said first control signal and second control signal being generated synchronously at separate times and in opposite logic states with respect to each other;

ON/OFF circuit means for generating an ON signal when the appliance is energized with electrical power; and AND gate means having first input coupled to said first alarms means for receiving said alarm failure signal, a second input for receiving said second control signal and a third input for receiving said ON signal, said AND gate means generating an output signal to cause said second alarm means to generate said second alarm signal only when said alarm failure signal, second control signal and ON signal are of the same logic state and are simultaneously applied to the first, second and third inputs thereof.

* * * * *